US005482427A

United States Patent [19]

Olson

[11] Patent Number: 5,482,427

[45] Date of Patent: Jan. 9, 1996

[54] HORIZONTAL LOADING APPARATUS

[75] Inventor: Allen L. Olson, Crosby, Minn.

[73] Assignee: Riverwood International Corporation, Denver, Colo.

[21] Appl. No.: 154,947

[22] Filed: Nov. 19, 1993

[51] Int. Cl.[6] ..... B65B 35/54; B65G 57/14

[52] U.S. Cl. ..... 414/789.6; 414/794.8; 198/418.3; 53/543; 53/154

[58] Field of Search ..... 414/789.6, 794.9, 414/794.8; 198/418.2, 418.3, 419.3, 419.2, 418.4; 53/543, 154

[56] References Cited

U.S. PATENT DOCUMENTS

| | | | |
|---|---|---|---|
| 3,850,282 | 11/1974 | Calvert | 198/418.4 |
| 4,341,298 | 7/1982 | Dingli | 198/418.3 |
| 4,673,078 | 6/1987 | Swiatlowski et al. | 198/418.2 X |
| 4,711,339 | 12/1987 | Nagata et al. | 198/418.2 X |
| 4,880,102 | 11/1989 | Indrebo | 198/418.3 |
| 4,936,077 | 6/1990 | Langen et al. | 198/418.2 X |
| 5,161,302 | 11/1992 | Mueller | 198/418.4 X |

FOREIGN PATENT DOCUMENTS

| | | | |
|---|---|---|---|
| 538765 | 4/1993 | European Pat. Off. | 53/543 |
| 1244048 | 7/1967 | Germany | 198/418.4 |
| 3839498 | 5/1990 | Germany | 198/418.3 |

*Primary Examiner*—Andres Kashnikow
*Assistant Examiner*—Lesley D. Morris
*Attorney, Agent, or Firm*—Joel D. Skinner, Jr.; Steve McLary

[57] ABSTRACT

An apparatus for forming stacked article groups in a packaging process, comprising a linear conveyance mechanism having an upstream end and a downstream end; and at least one article input and combining station, the article input and combining station including high and low article input lines and a combining wheel, the combining wheel being disposed tangentially with respect to the conveyance mechanism and further being arranged to receive a high single level article group from the high input line and to transport the high single level article group to a point of intersection with the conveyance mechanism, the low article input line intersecting the conveyance mechanism at a position which is located upstream with respect to the intersection point and depositing a low single level article group on the conveyance mechanism, and wherein the combining wheel merges the high and low single level article groups to form the stacked article group at the intersection point.

21 Claims, 2 Drawing Sheets

HORIZONTAL LOADING APPARATUS

BACKGROUND OF THE INVENTION

1. Field of the Invention

This invention relates to packaging methods and apparatus. Particularly, this invention relates to a method of forming stacked or multiple layer article groups outside packaging media, which utilizes a divider panel between top and bottom members of each group. The packaging method of the present invention is usable to package different types, styles and sizes of articles, in a wide range of stacked group patterns, and into a variety of packaging media, in a fast and reliable manner.

2. Background Information

In the past, various apparatus and processes have been proposed and utilized to package selected article groups. Outside of Applicant's assignee, no process or apparatus, insofar as is known provides reliable, high speed packaging of stacked or layered product groups. Applicant's assignee is the owner of several pending U.S. patent applications directed to methods and apparatus for forming stacked beverage can carriers. However, none of these applications are related to the invention disclosed and claimed herein.

It is an object of this invention to provide a method of reliably forming stacked product groups at high speed. Another object of this invention is to provide a packaging method which is usable with a variety of package types, articles and stacked group configurations and sizes. A particular object of the invention is to provide an apparatus and method for forming stacked or multiple layer article groups outside of a packaging member for subsequent packaging purposes.

SUMMARY OF THE INVENTION

The present invention provides an apparatus and method for forming stacked article groups outside a carrier or other packaging media. In one embodiment, the invention provides an apparatus for forming stacked article groups in a packaging process, comprising:

a) a linear conveyance mechanism having an upstream end and a downstream end; and b) at least one article input and combining station, the article input and combining station including high and low article input lines and a combining wheel, the combining wheel being disposed tangentially with respect to the conveyance mechanism and further being arranged to receive a high single level article group from the high input line and to transport the high single level article group to an intersection point with the conveyance mechanism, the low article input line intersecting the conveyance mechanism at a position which is located upstream with respect to the intersection point and depositing a low single level article group on the conveyance mechanism, and wherein the combining wheel merges the high and low single level article groups to form the stacked article group at the intersection point.

In a preferred embodiment, the article input and combining stations are arranged at predetermined intervals along the conveyance mechanism, a first article input and combining station forming a first stacked article subgroup on the conveyance mechanism, each successive article input and combining station adding a successive stacked article subgroup to its preceding stacked article subgroup to form a combined stacked article group.

These and other benefits of this invention will become clear from the following description by reference to the drawings.

DESCRIPTION OF THE PREFERRED EMBODIMENT

Figure 1:
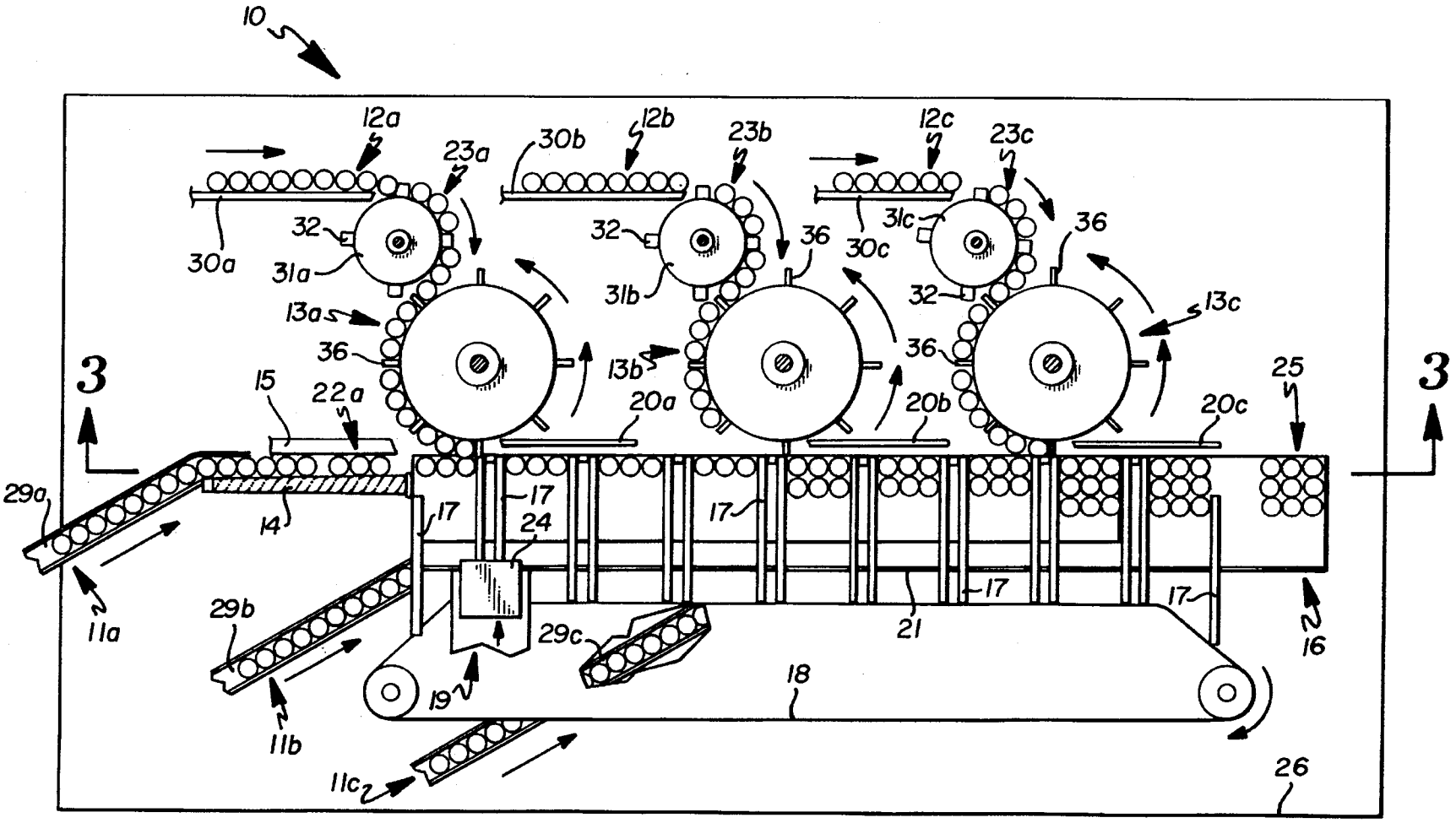
FIG. 1 is a plan view of the packaging apparatus of the present invention.

The processes and apparatus of the present invention are for forming stacked article groups in a high speed packaging operation. As shown in the drawings, the method of this invention is implemented via a high-speed packaging apparatus 10. The apparatus 10 is adjustable to provide reliable, continuous and high speed packaging of cylindrical articles or products of varying types, sizes and quantities into packages of varying types and sizes. For example, the apparatus 10 is usable to load standard twelve ounce beverage cans into 12 (6/6), 18 (9/9) and 24 (12/12) pack stacked combinations. Moreover, the process of loading beverage containers into paperboard cartons, for example, is accomplished quickly and reliably, under typical industry tolerances for both container and carton construction.

Figure 2:
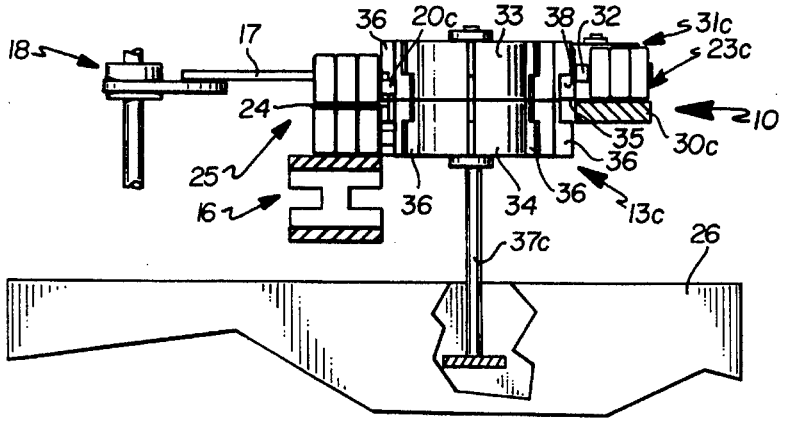
FIG. 2 is an end view of the apparatus shown in FIG. 1.

Referring to FIGS. 1 and 2, the horizontal loader apparatus 10 generally comprises low and high article (beverage can) infeed lines 11*a–c* and 12*a–c*, one or more combining wheels 13*a–c*, one or more metering screws 14, a metering conveyor 16, flight bars 17, and a divider sheet feeder 19. These elements are preferably supported by a unitary frame structure 26.

In use, articles such as cylindrical beverage containers 38 are provided at an upstream or input end of the apparatus 10, from two basic (low and high) locations. The containers 38 may be input to the apparatus 10 from a container filling process located upstream. The containers 38 are first separated into low and high article groups 22*a–c* and 23*a–c*. The two groups 22*a–c* and 23*a–c* are then merged into a stacked subgroup and a divider sheet 24 is inserted between the top and bottom members of the subgroup. The subgroups shown in the drawings consist of six (6) members formed in top and bottom lines or rows of three (3). The divider sheet 24 is held in place by the weight of the containers and preferably by a support guide. The subgroup is then transported linearly downstream where additional stacked subgroups are added from one side of the existing group. Thus, for example, the first subgroup is moved laterally with respect to the longitudinal or downstream axis of the apparatus 10 by the addition of a second subgroup from one side to form an intermediary group of twelve (12) members stacked three in a row and two across. In the example, the final subgroup is added in the same manner at the downstream end to form a completed stacked group 25 of eighteen (18) members stacked three in a row and three across. The completed stacked group 25 is then transported downstream where it is loaded for example into a paperboard carton via side loading or sleeving process known in the art. Alternative methods of packaging of the stacked group 25 include shrink wrapping, banding or having paperboard or other material formed around them.

The low article infeed lines 11*a–c* are shown to consist of single lane conveyors 29*a–c* which are linearly oriented and approach the apparatus 10 from one side thereof at an angle. At the point where the line 11*a* intersects with the metering screw 14, cans 38 traveling on the line 11*a* begin traveling longitudinally along the main axis of the apparatus 10. In an alternative embodiment, the cans 38 may be pre-metered and formed into groups 22*b* and 22*c* prior to input to the apparatus 10 as is shown for example in lines 11*b* and 11*c*. In such a case, the metering screw 14 can be eliminated. Pre-metering can be accomplished by various means known in the art. A lane guide 15 is disposed to the side of the metering conveyor and in parallel with the metering screw 14 to form a conveyance path for the cans. The metering screw 14 is of standard design for spacing the trailing member of a formed group of cans from the leading member of a trailing group. The formed groups 22*a–c* are subsequently moved downstream on the metering conveyor 16 for processing by the combining wheels 13*a–c*.

The high article infeed lines 12*a–c* consist of a single lane conveyor 30*a–c* and an infeed lugged wheel 31*a–c*. The wheels 3l*a–c* have spaced lugs 32 disposed at predetermined intervals which, along with the diameter of the wheels 31*a–c*, determine the size of the article group 23*a–c* selected thereby. The lugs 32 select a can group 23*a–c* from the unmetered supply of cans 38 disposed at the end of the conveyor 30*a–c*. As the wheels 31*a–c* rotate, the selected groups 23*a–c* are moved into position for transfer to the combining wheels 13*a–c*. Importantly, the vertical level of the high article infeed lines 12*a–c* is above that of the low article infeed lines 11*a–c*. As a result, the article groups 22*a–c* and 23*a–c* formed by the respective lines 11*a–c* and 12*a–c* are disposed at predetermined differential vertical levels for engagement by the combining wheels 13*a–c*.

Figure 3:
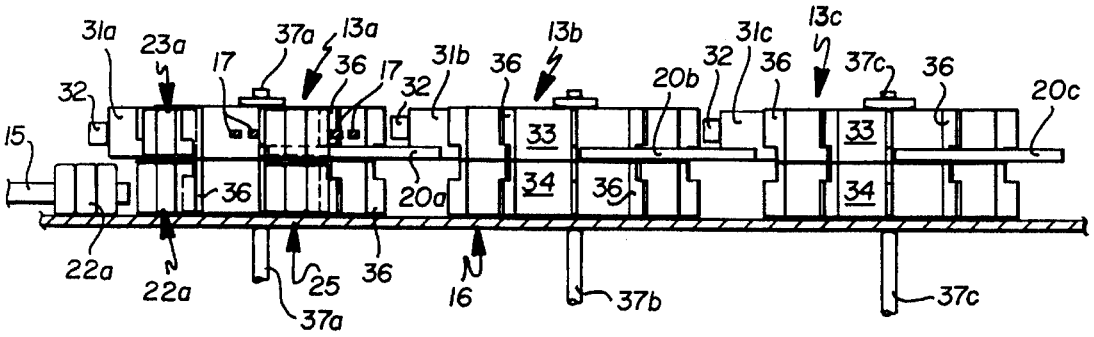
FIG. 3 is a side view of the apparatus, taken generally along line 3—3 of FIG. 1.
Figure 4:
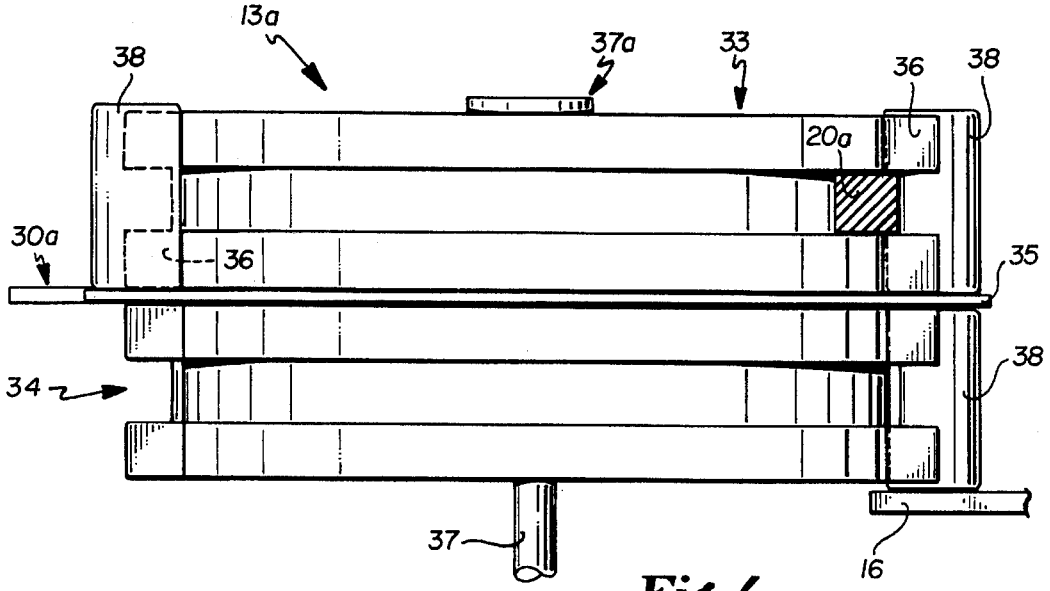
FIG. 4 is an end view, partly in crossection of the apparatus.

Referring also to FIGS. 3 and 4, the combining wheels 13*a–c* basically comprise an upper portion 33, a lower portion 34, a central, planar plate member 35, and circumferentially disposed pockets 36. The combining wheels 13*a–c* are circular in shape and are driven by vertically oriented, axially disposed drive shafts 37*a–c*. Preferably, the drive shafts 37*a–c* are synchronized via a common power source (not shown). The movement of the combining wheels 13*a–c* is synchronized with the high article infeed lugged wheels 31*a–c* and the metering conveyor 16. The combining wheels 13*a–c* have a predetermined diameter and a predetermined number of pockets 36 which are a function of the article groups 22*a–c* and 23*a–c* size. The width of the bifurcated combining wheels 13*a–c* is a function of the height of the cans 38. The size and configuration of the pockets is a function of the size, particularly the diameter, of the cans 38, as well as that of the groups 22*a–c* and 23*a–c*.

The combining wheels 13*a–c* are configured to receive article groups 23*a–c* from the high lines 12*a–c*, to transport them into alignment with the low article groups 22*a–c* traveling on the metering conveyor 16, whereby the two groups 23*a–c* and 22*a–c* are merged or combined at a predetermined intersection position to form stacked subgroups as defined above. Upon subgroup formation, a stripper bar 20*a–c* extracts the formed subgroup from the combining wheel 13*a–c* so that the subgroup continues to travel downstream on the conveyor 16. The plate 35 supports the high group 23*a–c* during engagement by the combining wheel 13*a–c*.

The divider sheet feeder 19 is disposed adjacent to the first combining wheel 13*a*. The sheet feeder 19 dispenses divider sheets 24 in synchronization with the forming of the first article subgroups. In a preferred embodiment, the divider sheet 24 is formed of paperboard of a predetermined thickness and having a horizontal or planar dimension which is equivalent to that of the completed article group 25. The divider sheet provides a low friction base for movement of newly inserted subgroups into proper orientation beside the previously formed subgroup or intermediary group. The lateral edge of the divider sheet 24 which is farthest from the combining wheel 13*a–c* is engaged by a stabilizing rail 21 which holds the divider sheet 24 in proper position and at the same time allows it to move downstream with the article group.

The flight bars 17 stabilize the article subgroups, intermediary groups and completed groups as they are transported downstream on the metering conveyor 16. In particular, the flight bars 17 retain the front or leading edge and the back or trailing edge of the forming groups as new members are added by the action of the combining wheels 13*a–c*. This is a critical function due to the height of the stacked groups. The flight bars 17 are preferably arranged in pairs which are disposed at predetermined intervals on a drive mechanism 18 which is disposed adjacent to the metering conveyor 16. The spacing of the flight bar 17 pairs is preferably adjustable and corresponds to the length of the article subgroup or group being metered. The drive mechanism 18 moves the flight bars 17 in a longitudinal direction to control the motion of the conveyed article groups. The drive mechanism 18 is constructed and arranged in a continuous loop whereby flight bars 17 are returned from the end of the conveyor 16 to its beginning. The ends of the drive mechanism 18 are arranged so that the flight bars 17 smoothly engage and disengage the article groups. Continuous systems such as this are disclosed in U.S. Pat. No. 5,241,806, issued Sep. 7, 1993 to Applicant's assignee, which is hereby incorporated by reference. The metering conveyor 16 is of a continuous design. The metering conveyor 16 is disposed tangentially with respect to the combining wheels 13*a–c* and extends a predetermined length to receive formed article groups from the wheels 13*a–c* and deliver them downstream to an output location. Upon output, the stacked article groups 25 are processed by related packaging apparatus for example.

Although the apparatus 10 shown in the drawings is preferably utilized in a beverage can cartoning operation with paperboard cartons or carriers, modifications consistent with the teachings; of this invention may be made to package various other stacked containers or articles in various carrier configurations or to package the article groups via shrink wrapping, banding or the like. And although the apparatus is shown with three (3) bifurcated input locations and three (3) processing stations to form eighteen pack stacked groups, the apparatus may have one, two, four or more stations and input locations consistent with the basic teaching of the invention. Further, input subgroup size selection or formation may be altered to change the configuration of the end product group, again consistent with the basic teachings of the invention.

As many changes are possible to the embodiments of this invention utilizing the teachings thereof, the descriptions above, and the accompanying drawings should be interpreted in the illustrative and not the limited sense.

That which is claimed is:

1. An apparatus for forming stacked article groups in a packaging process, comprising:

a) a linear conveyance mechanism having an upstream end and a downstream end; and b) a plurality of article input and combining stations, said article input and combining stations being arranged at predetermined intervals along said conveyance mechanism, a first article input and combining station forming a first stacked article subgroup on said conveyance mechanism, each successive article input and combining station adding a successive stacked article subgroup to its preceding stacked article subgroup to form a combined stacked article group, each said article input and combining station including:

high and low article input lines and a combining wheel, said combining wheel being disposed tangentially with respect to said conveyance mechanism and further being arranged to receive a high single level article group from said high input line and to transport said high single level article group to a point of intersection with said conveyance mechanism, said low article input line being disposed at a predetermined vertical level and aligned with said conveyance mechanism at a predetermined angle so as to intersect said conveyance mechanism at a position which is located upstream with respect to said intersection point and deposit a low single level article group on said conveyance mechanism, said low article input line including a conveyor and a metering screw, said metering screw being oriented parallel with respect to said conveyance mechanism, and wherein said combining wheel merges said high and low single level article groups to form a respective said stacked article subgroup at said intersection point.

2. The apparatus of claim 1, wherein said high article input line is disposed at a predetermined vertical level and is aligned with said combining wheel on a side opposite said intersection point.

3. The apparatus of claim 2, wherein said high article input line comprises a conveyor and a bugged wheel disposed proximate a terminal end of said conveyor.

4. The apparatus of claim 3, wherein said lugged wheel is further disposed at a predetermined position to intersect with said combining wheel, said lugged wheel metering the size of said high single level article group and transferring said high single level article group to said combining wheel.

5. The apparatus of claim 1, further comprising a divider sheet feeder disposed at a predetermined location adjacent said conveyance mechanism, upstream with respect to said combining wheel, said divider sheet feeder depositing a divider sheet on a top surface of said low single level article group.

6. The apparatus of claim 5, further comprising means to stabilize said deposited divider sheet.

7. The apparatus of claim 1, wherein said combining wheel is a bifurcated structure with top and bottom members.

8. The apparatus of claim 7, wherein said combining wheel further has a horizontal plate member and a plurality of circumferentially disposed pockets.

9. The apparatus of claim 1, wherein there are three article input and combining stations.

10. The apparatus of claim 1, wherein the apparatus is adjustable to vary the size and configuration of the stacked article group.

11. The apparatus of claim 1, further comprising a flight bar mechanism disposed adjacent said conveyance mechanism, said flight bar mechanism having a plurality of flight bars spaced at predetermined intervals, said flight bars further being operative above said conveyance mechanism to stabilize the formation and transport of said stacked article group.

12. The apparatus of claim 1, wherein said article input and combining station further comprises a stripper bar.

13. The apparatus of claim 1, wherein said low article input line comprises a conveyor and transports premetered low single level article groups thereon.

14. The apparatus of claim 1, wherein said high article input line is disposed at a first predetermined vertical level and is aligned with said combining wheel on a side opposite said intersection point, and wherein said low article input line is disposed at a second predetermined vertical level which is less than said first vertical level, and is aligned with said conveyance mechanism at a predetermined angle to transfer low single level article groups thereon.

15. The apparatus of claim 1, wherein the apparatus is integrated in a process whereby stacked article groups formed by the apparatus are subsequently packaged.

16. An apparatus for forming stacked article groups in a packaging process, comprising:

a linear conveyance mechanism having an upstream end and a downstream end;

a plurality of article input and combining stations, each said article input and combining station including first and second article input lines and a bifurcated combining wheel, said combining wheel being disposed tangentially with respect to said conveyance mechanism and further being arranged to receive a high single level article group from said first input line and to transport said high single level article group to an intersection point with said conveyance mechanism, said second article input line intersecting said conveyance mechanism at a position which is located upstream with respect to said intersection point and depositing a low single level article group on said conveyance mechanism, and wherein said combining wheel merges said high and low single level article groups to form a stacked article subgroup at said intersection point;

said high article input line being disposed at a first predetermined vertical level and aligned with said combining wheel on a side opposite said intersection point, and said low article input line being disposed at a second predetermined vertical level which is less than said first vertical level, and aligned with said conveyance mechanism at a predetermined angle to transfer low single level article groups thereon;

said article input and combining stations being adjustable to vary the size and configuration of said stacked article subgroups; and said article input and combining stations further being arranged at predetermined intervals along said conveyance mechanism, a first article input and combining station forming a first stacked article subgroup on said conveyance mechanism, each successive article input and combining station adding a successive stacked article subgroup to its preceding stacked article subgroup to form a combined stacked article group.

17. An apparatus forming stacked article groups in a packaging process, comprising:

a) a linear conveyance mechanism having an upstream end and a downstream end;

b) at least one article input and combining station, said article input and combining station including high and low article input lines and a combining wheel, said combining wheel being disposed tangentially with respect to said conveyance mechanism and further being arranged to receive a high single level article group from said high input line and to transport said high single level article group to a point of intersection with said conveyance mechanism, said low article input line intersecting said conveyance mechanism at a position which is located upstream with respect to said intersection point and depositing a low single level article group on said conveyance mechanism, and wherein said combining wheel merges said high and low single level article groups to form the stacked article group at said intersection point; and c) a divider sheet feeder disposed at a predetermined location adjacent said conveyance mechanism, upstream with respect to said combining wheel, said divider sheet feeder depositing a divider sheet on a top surface of said low single level article group.

18. An apparatus for forming stacked article groups in a packaging process, comprising:

a) a linear conveyance mechanism having an upstream end and a downstream end;

b) at least one article input and combining station, said article input and combining station including high and low article input lines and a combining wheel, said combining wheel being disposed tangentially with respect to said conveyance mechanism and further being arranged to receive a high single level article group from said high input line and to transport said high single level article group to a point of intersection with said conveyance mechanism, said low article input line intersecting said conveyance mechanism at a position which is located upstream with respect to said intersection point and depositing a low single level article group on said conveyance mechanism, and wherein said combining wheel merges said high and low single level article groups to form the stacked article group at said intersection point; and c) a flight bar mechanism disposed adjacent said conveyance mechanism, said flight bar mechanism having a plurality of flight bars spaced at predetermined intervals, said flight bars further being operative above said conveyance mechanism to stabilize the formation and transport of said stacked article group.

19. An apparatus for forming stacked article groups in a packaging process, comprising:

a) a linear conveyance mechanism having an upstream end and a downstream end; and b) at least one article input and combining station, said article input and combining station including high and low article input lines and a bifurcated combining wheel with top and bottom members, said combining wheel being disposed tangentially with respect to said conveyance mechanism and further being arranged to receive a high single level article group from said high input line and to transport said high single level article group to a point of intersection with said conveyance mechanism, said low article input line intersecting said conveyance mechanism at a position which is located upstream with respect to said intersection point and depositing a low single level article group on said conveyance mechanism, and wherein said combining wheel merges said high and low single level article groups to form the stacked article group at said intersection point.

20. An apparatus for forming stacked article groups in a packaging process, comprising:

a) a linear conveyance mechanism having an upstream end and a downstream end; and b) a plurality of article input and combining stations, said article input and combining stations being arranged at predetermined intervals along said conveyance mechanism, a first article input and combining station forming a first stacked article subgroup on said conveyance mechanism, each successive article input and combining station adding a successive stacked article subgroup to its preceding stacked article subgroup to form a combined stacked article group, each said article input and combining station including:

high and low article input lines, a combining wheel, and a stripper bar, said combining wheel being disposed tangentially with respect to said conveyance mechanism and further being arranged to receive a high single level article group from said high input line and to transport said high single level article group to a point of intersection with said conveyance mechanism, said low article input line intersecting said conveyance mechanism at a position which is located upstream with respect to said intersection point and depositing a low single level article group on said conveyance mechanism, and wherein said combining wheel merges said high and low single level article groups to form a respective said stacked article subgroup at said intersection point, said stripper bar extracting said article subgroup from said combining wheel.

21. An adjustable apparatus for forming various sized and configured stacked article groups in a packaging process, comprising:

a) a linear conveyance mechanism having an upstream end and a downstream end; and b) a plurality of article input and combining stations, said article input and combining stations being arranged at predetermined intervals along said conveyance mechanism, a first article input and combining station forming a first stacked article subgroup on said conveyance mechanism, each successive article input and combining station adding a successive stacked article subgroup to its preceding stacked article subgroup to form a combined stacked article group, each said article input and combining station including:

adjustable high and low article input lines and a combining wheel, said combining wheel being disposed tangentially with respect to said conveyance mechanism and further being arranged to receive a high single level article group from said high input line and to transport said high single level article group to a point of intersection with said conveyance mechanism, said low article input line intersecting said conveyance mechanism at a position which is located upstream with respect to said intersection point and depositing a low single level article group on said conveyance mechanism, and wherein said combining wheel merges said high and low single level article groups to form a respective said stacked article subgroup at said intersection point.

* * * * *